US007013910B2

(12) United States Patent
Tripp

(10) Patent No.: US 7,013,910 B2
(45) Date of Patent: Mar. 21, 2006

(54) BACK FLOW PREVENTER MADE OF AT LEAST TWO DIFFERENT TYPES OF MATERIAL

(75) Inventor: Dale S. Tripp, Hartsville, SC (US)

(73) Assignee: Anderson Brass Company, Hartsville, SC (US)

( * ) Notice: Subject to any disclaimer, the term of this patent is extended or adjusted under 35 U.S.C. 154(b) by 0 days.

(21) Appl. No.: 10/821,258

(22) Filed: Mar. 24, 2004

(65) Prior Publication Data

US 2005/0211299 A1 Sep. 29, 2005

(51) Int. Cl.
*F16K 24/00* (2006.01)

(52) U.S. Cl. ..... 137/218; 137/512

(58) Field of Classification Search ..... 137/218, 137/512

See application file for complete search history.

(56) References Cited

U.S. PATENT DOCUMENTS 4,139,469 A * 2/1979 Rainin et al. ..... 137/512

5,228,470 A 7/1993 Lair et al.

OTHER PUBLICATIONS

Watts Publication, 1998.
Conbraco Pulication, 2000.
http://www.neoperl.com/products/checkvalves/features.asp.
http://www.neoperl.com/products/checkvalves/principles.asp.

* cited by examiner

*Primary Examiner*—John Fox
(74) *Attorney, Agent, or Firm*—Dority & Manning, P.A.

(57) ABSTRACT

A back flow preventer is provided that is made of at least two different materials. The back flow preventer includes a housing that has a passageway configured for the transport of a fluid therethrough. The housing has both an inlet and an outlet that define at least a portion of the passageway. The inlet is made of a different material than the outlet. A first and second check valve are disposed in the passageway. Both of the check valves allow fluid to flow through the passageway in the direction from the inlet to the outlet of the housing.

20 Claims, 3 Drawing Sheets

BACK FLOW PREVENTER MADE OF AT LEAST TWO DIFFERENT TYPES OF MATERIAL

TECHNICAL FIELD OF THE INVENTION

The present invention relates generally to a back flow preventer for preventing unwanted fluid from contaminating a different, separate fluid such as a water supply source. The back flow preventer is made of at least two different types of material, and may be configured with a vent that is intermittent a pair of check valves.

BACKGROUND

The process of mixing two fluids together in a mixing tank can potentially result in a contamination of the first fluid source with the second fluid. For instance, if the pressure in the mixing tank is greater than the supply pressure of the first fluid source, back flow could occur to cause the mixed fluid, now containing the second fluid, to enter and contaminate the first fluid source.

Carbonated beverage dispensers employ a carbonator tank (mixing tank) into which drinking water is mixed with carbon dioxide in order to form carbonated water. The carbonated water is subsequently mixed with juice or another liquid in order to form a carbonated beverage (also referred to as a "soft drink"). In such a system, it is undesirable to have carbon dioxide gas exposed to the copper plumbing that frequently is used to house and transport the drinking water. The carbon dioxide gas may corrode copper in the copper plumbing, allowing entrained copper to enter the dispensing system. A person drinking the soft drink may get copper poisoning upon consumption.

A vented dual check back flow preventer may be used in such systems in order to isolate the carbonator tank from the drinking water supply. This type of back flow preventer employs a vent between a pair of check valves that only allow fluid to travel in one direction, thus preventing carbonated water from contacting copper plumbing used with the drinking water supply. In the event a check valve fails, the carbonated water in the back flow preventer will be channeled out of the vent between the check valves and will not enter the drinking water supply.

The back flow preventer typically marks the dividing point between copper based materials that are used upstream from the back flow preventer and connected to the drinking water supply and non-copper based materials that are used downstream from the back flow preventer and are connected to the carbonator tank. Conventional vented dual check back flow preventers used in beverage dispensers have housings that are made entirely of either stainless steel or are made entirely of plastic. By avoiding copper based materials, back flow preventers ensure that the back flow preventer itself does not contaminate the drinking water supply. However, back flow preventers with housings made entirely of stainless steel are expensive, while housings made entirely of plastic do not provide adequate strength.

Accordingly, a back flow preventer that protects the drinking water supply from contamination that is less expensive than back flow preventers employing stainless steel housings and stronger than those employing plastic housings would be useful.

SUMMARY

Various features and advantages of the invention will be set forth in part in the following description, or may be obvious from the description. The present invention provides for a back flow preventer that includes a housing with a passageway configured for the transport of a fluid therethrough. The housing has both an inlet and an outlet that each define at least a portion of the passageway. The inlet is made of a different material than the outlet. A first and second check valve are disposed in the passageway, and are each configured for allowing fluid to flow through the passageway in the direction from the inlet to the outlet.

The present invention also provides for a back flow preventer that has a housing comprising a body intermediate the inlet and outlet of the housing. The inlet has an inlet surface that defines an inlet passageway, and the outlet has an outlet surface that defines an outlet passageway. The body likewise has a body surface that defines a body passageway. The inlet surface is made of a first material while the body surface and the outlet surface are made of a second and third material respectively. The first material is different than both the second and third materials. The passageways allow for the transport of a fluid therethrough. The first check valve has a first check valve seat that is disposed between the inlet passageway and the body passageway. The first check valve is configured to allow fluid to flow from the inlet passageway to the body passageway. The second check valve is disposed in the body passageway and is configured for allowing fluid to flow from the body passageway to the outlet passageway.

Portions of the back flow preventer are made from different materials. For instance, the inlet may be made of a material that is copper based, such as brass, while the outlet is made of a non-copper based material such as stainless steel. The surface of the housing forming the passageway from the inlet to a seat of the first check valve may be made of a copper based material, and the surface of the housing forming the passageway from the seat of the first check valve to the outlet may be made of a non-copper based material in accordance with other exemplary embodiments.

The back flow preventer as discussed above may further include a resilient diaphragm that is disposed in the passageway and engages the first check valve. A vent is defined by the housing and is located between the first and second check valves. During a failed condition of the back flow preventer, the passageway is in fluid communication with the vent and fluid located between the first and second check valves is allowed to exit the housing through the vent. During normal operation, the diaphragm flexes so that the vent is isolated from fluid communication with the passageway and fluid cannot escape through the vent.

The back flow preventer may also be configured so the inlet may be threaded directly onto a pump. Further, the outlet may be configured for attachment to a stainless steel tube. The check valves used in the back flow preventer may be poppet style check valves. Additionally, the second check valve may be made at least partially of plastic in certain exemplary embodiments.

The present invention also provides a back flow preventer with a housing that has a body intermediate an inlet and an outlet. The inlet has an inlet surface that is made of brass that defines an inlet passageway. The body has a body surface made of stainless steel that defines a body passageway, and the outlet has an outlet surface made of stainless steel that defines an outlet passageway. The three passageways are configured for allowing the transport of a fluid therethrough.

A first check valve seat of a first check valve is disposed between the inlet and body passageways. The first check valve allows fluid to flow from the inlet passageway to the body passageway. A second check valve is also included and is disposed in the body passageway. The second check valve allows fluid to flow from the body passageway to the outlet passageway. A resilient diaphragm is incorporated into the first check valve seat and selectively isolates a vent that is defined by the housing and is located between the first and second check valves. During a failed condition, the resilient diaphragm is open so the body passageway is in fluid communication with the vent and fluid located in the body passageway is allowed to exit the housing through the vent.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

DETAILED DESCRIPTION OF PREFERRED EMBODIMENTS

Figure 1:
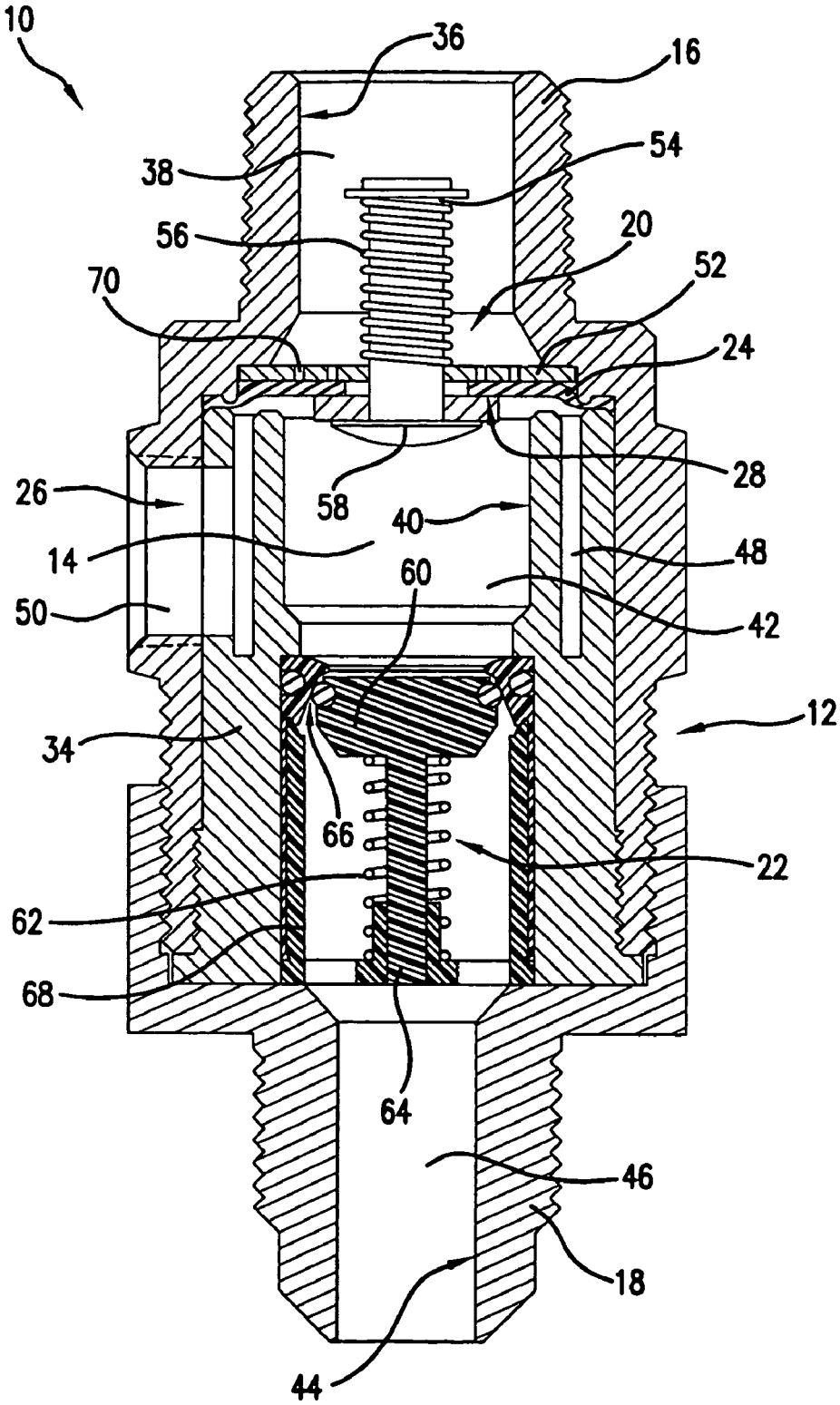
FIG. 1 is a cross-sectional view of an exemplary embodiment of a back flow preventer in accordance with the present invention. The back flow preventer is in an at rest position with no fluid flow therethrough.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

The present invention provides for a back flow preventer 10, as shown for instance in FIG. 1, that is used to prevent fluid from receding past a certain location. Back flow preventer 10 can be used, for instance, in a water supply line that provides drinking water to a carbonator tank. The carbonator tank is also provided with carbon dioxide in order to form carbonated water. Back flow preventer 10 prevents carbonated water from receding into the source of the drinking water in instances where the pressure downstream of back flow preventer 10 increases, or if the system pressure upstream of back flow preventer 10 decreases such that flow through back flow preventer 10 might attempt to reverse. Back flow preventer 10 is made of at least two different types of material. For instance, an inlet 16 may be made of brass, while an outlet 18 is made of stainless steel. This configuration is advantageous in that brass is on the order of four times less expensive than stainless steel, hence such a configuration significantly reduces the cost of back flow preventer 10. Carbon dioxide is prevented from interacting with copper present in inlet 16 and upstream of this location due to the presence of a first check valve 20 that closes during back flow or failed conditions. By making back flow preventer 10 of two different materials, the cost prohibitive situation of having the back flow preventer 10 made entirely of stainless steel is avoided, and likewise a less robust plastic material in the use of back flow preventer 10 is avoided. Back flow preventer 10 may therefore form a separation point not only between potable and non-potable fluid, but between copper and non-copper based flow conduits.

Back flow preventer 10 includes housing 12 that has inlet 16 and outlet 18 located on opposite ends. Housing 12 also has a body 34 located between both inlet 16 and outlet 18. A passageway 14 is defined through housing 12 for allowing fluid to flow therethrough. A first and second check valve 20, 22 are used to prevent back flow of fluid through passageway 14 in the direction from outlet 18 to inlet 16. First and second check valves 20, 22 may be poppet style check valves for example. The positioning of first check valve 20 allows for inlet 16 to be made of a copper based material, such as brass as described above, while other portions of housing 12 such as body 34 and outlet 18 are made of a non-copper based material, such as stainless steel or plastic. Body 34 is not made of a copper-based material in the event second check valve 22 fails. If body 34 were made of a copper-based material, failure of second check valve 22 would allow back flow into body 34 and interaction of carbon dioxide in the fluid with copper in body 34.

In accordance with certain exemplary embodiments of the present invention, the entire inlet 16 may be made of a copper based material. Alternatively, only the inlet surface 36 of inlet 16 may be made of a copper based material while the rest of inlet 16 is made of a non-copper based material. As shown, inlet surface 36 defines an inlet passageway 38 portion of passageway 14. Since only inlet surface 36 of inlet 16 contacts fluid in inlet passageway 38, it is not necessary to make other parts of inlet 16 of a copper based material. Alternatively, the entire inlet 16 may be made of a copper based material in certain exemplary embodiments.

Likewise, the entire body 34 and outlet 18 need not be made of a non-copper based material. Body surface 40 of body 34 defines a body passageway 42 portion of passageway 14, and outlet surface 44 of outlet 18 defines an outlet passageway 46 of passageway 14. The body surface 40 and outlet surface 44 are the only components of body 34 and outlet 18 that contact fluid flowing through housing 12. As such, outlet surface 44 and body surface 40 may be made of a non-copper based material such as stainless steel or plastic, while other portions of body 34 and outlet 18 are made of copper based materials since these portions do not contact fluid flowing through housing 12. In other exemplary embodiments of the present invention, the entire body 34 and outlet 18 are made of a non-copper based material. Body 34 and outlet 18 may both be made of the same material, or can be made of separate materials. For instance, body 34 may be made of stainless steel while outlet 18 is made of plastic.

Housing 12 is provided with a vent 26 that is used to vent fluid from housing 12 in the event back pressure occurs and second check valve 22 fails. Vent 26 is made of an annular chamber 48 disposed radially outward from passageway 14, and in fluid communication with passageway 14, while in the at rest position shown in FIG. 1. Vent 26 also includes an exhaust passageway 50 that is in fluid communication with annular chamber 48. As shown, exhaust passageway 50 may be defined by both inlet 16 and body 34 while annular chamber 48 is defined solely by body 34. However, in accordance with other exemplary embodiments of the present invention, various portions of housing 12 may be used in order to define vent 26 as is commonly known to one of ordinary skill in the art.

First check valve 20 is normally in a closed, at rest position as shown in FIG. 1. Spring tension from spring 56 forces valve plunger 54 to be moved upwards in FIG. 1, and subsequently valve head 58 that is connected to valve plunger 54 is forced upwards and contacts resilient diaphragm 24 in order to form a seat 28 of first check valve 20. An opposite side of resilient diaphragm 24 rests on a washer 52. As can be seen, flow through passageway 14 from inlet 16 into body 34 is prevented due to closure of first check valve 20. All fluid contacting surfaces in passageway 14 downstream of seat 28, those being body surface 40 and outlet surface 44, should be made of a non-copper based material in order to avoid contamination.

Second check valve 22 is also normally in a closed position as shown in FIG. 1. Here, tension in spring 62 causes valve plunger 64 and attached valve head 60 to be urged against wall 68, thus forming seat 66 of second check valve 22. As can be seen, fluid flow through passageway 14 from body 34 to outlet 18 is prevented by closure of second check valve 22.

Figure 2:
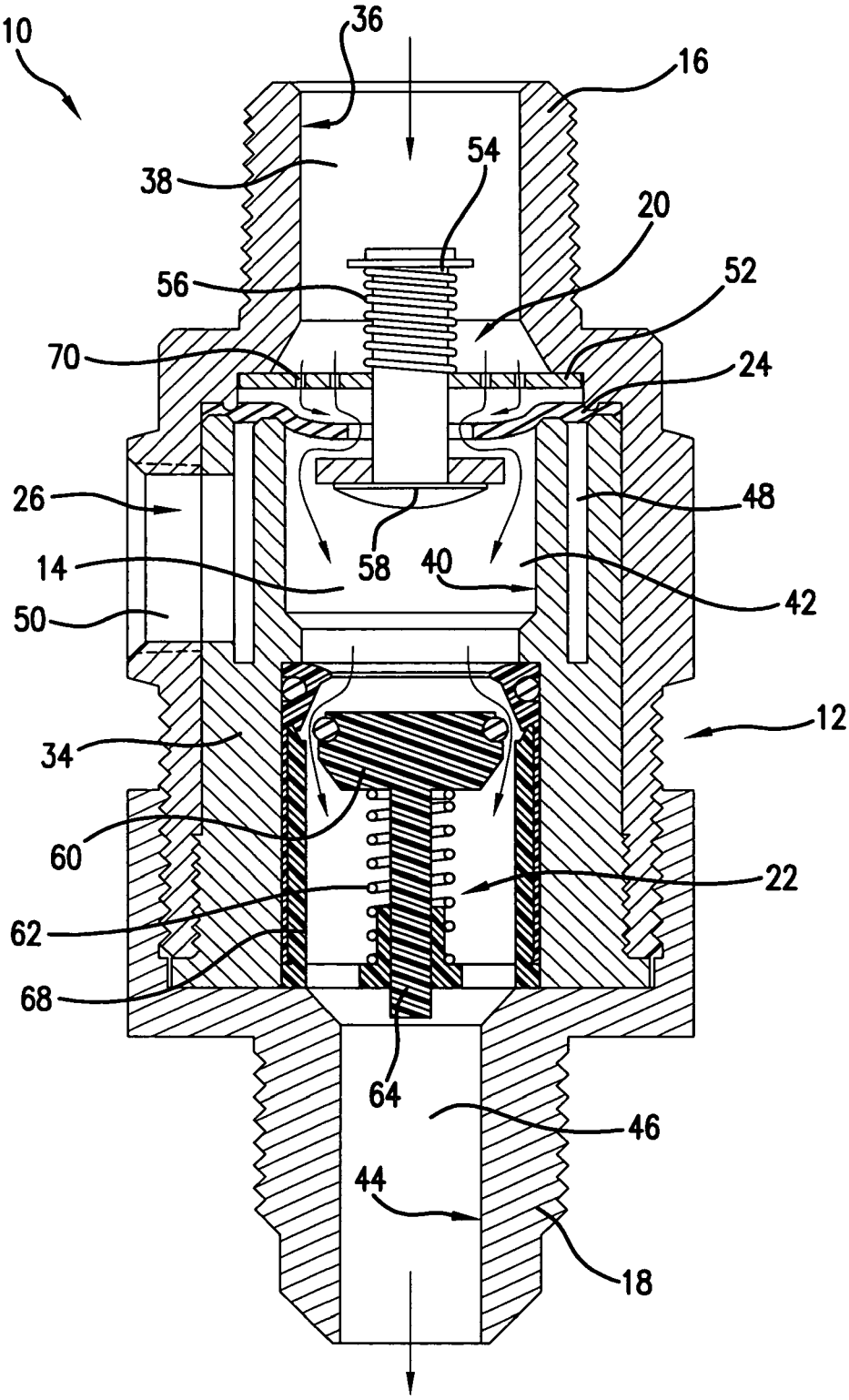
FIG. 2 is cross-sectional view of the back flow preventer of FIG. 1 in an open position. Here, fluid flows through the back flow preventer from the inlet to the outlet.

FIG. 2 shows the back flow preventer 10 of FIG. 1 when fluid flow exists between inlet 16 and outlet 18. In this instance, fluid pressure exceeds the tension in spring 56, causing valve plunger 54 to be moved downward and hence separating valve head 58 from seat 28 allowing fluid to flow through the first check valve 20. Likewise, sufficient fluid pressure on valve head 60 causes tension in spring 62 to be overcome such that valve head 60 and valve plunger 64 are displaced downward causing valve head 60 to be separated from seat 66 and allowing fluid to flow through second check valve 22. Once opened, valve heads 58, 60 will remain open due to the force of fluid flowing against the valve heads 58, 60.

Washer 52 is provided with a plurality of apertures 70 through which fluid pressure acts on resilient diaphragm 24. Once valve head 58 is moved downward, fluid pressure causes resilient diaphragm 24 to flex downward so that access between passageway 14 and annular chamber 48 is blocked by resilient diaphragm 24. It is therefore the case that during normal fluid flow through back flow preventer 10, fluid is prevented from exiting vent 26 by resilient diaphragm 24 and is directed through second check valve 22 and out of outlet 18.

When fluid flow is stopped through back flow preventer 10, valve head 58 is pulled back into the at rest position shown in FIG. 1 due to tension in spring 56. Likewise, resilient diaphragm 24 will return to its at rest position shown in FIG. 1 due to its shape retaining memory, or upon urging by valve head 58 when valve head 58 returns to the at rest position in FIG. 1. Second check valve 22 will also return to its normally closed position upon reduction of fluid flow on valve head 60.

If fluid pressure downstream of back flow preventer 10 increases or if the fluid pressure upstream from back flow preventer 10 decreases, fluid flow through back flow preventer 10 will attempt to reverse. This causes a closing of first and second check valves 20, 22 as seen in FIG. 1. Back flow through back flow preventer 10 is prevented by both first and second check valves 20, 22. Flow against valve head 58 in an upwards direction in FIG. 1 will form a seal on seat 28 and will not allow fluid to be transferred through passageway 14 from body 34 to inlet 16. In a similar manner, flow against the bottom of valve head 60 in an upwards direction in FIG. 1 will cause a seal to be formed on seat 66, thus preventing fluid from flowing through passageway 14 from outlet 18 to body 34.

Figure 3:
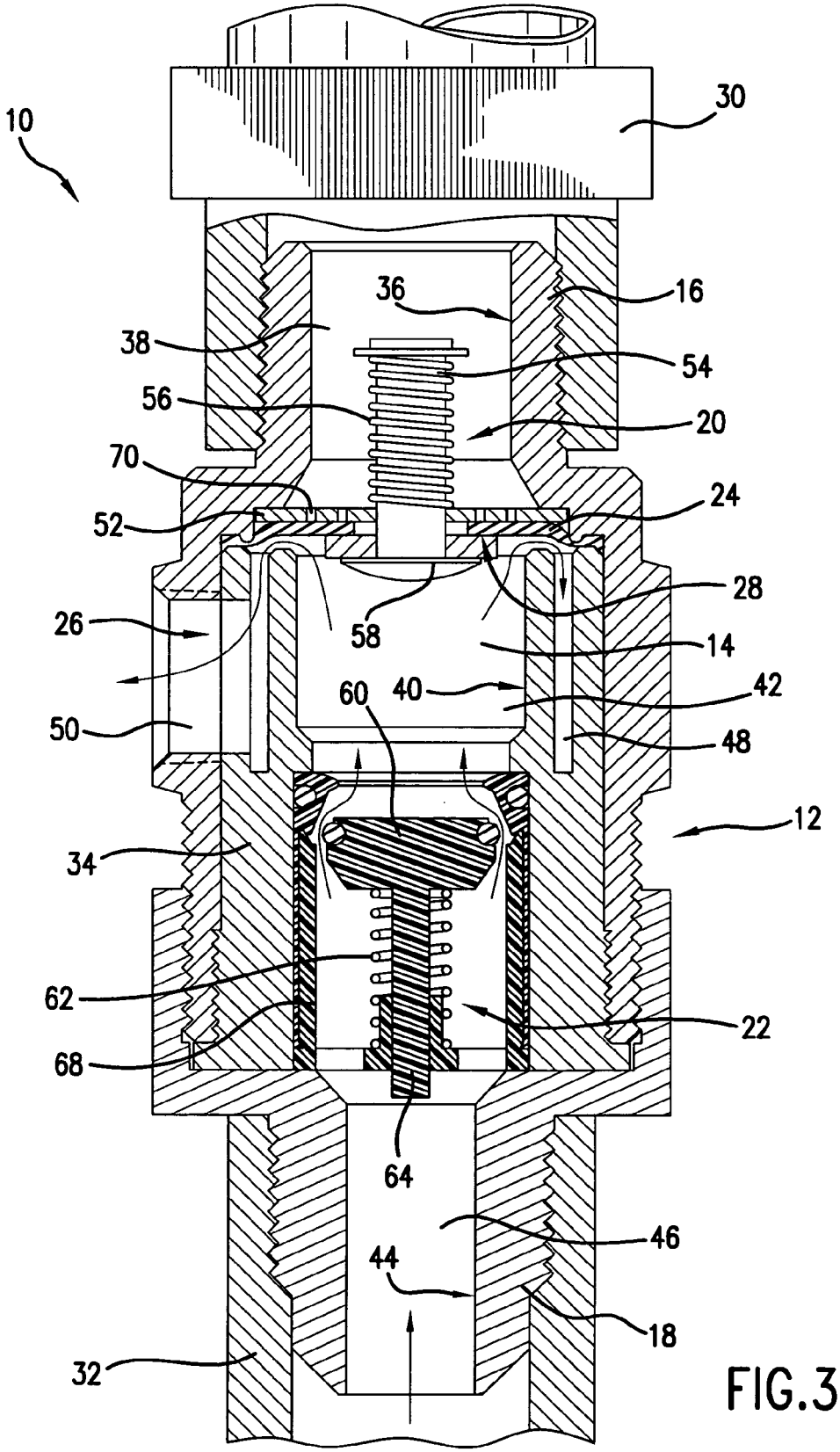
FIG. 3 is cross-sectional view of the back flow preventer of FIG. 1 in a failed condition. In this instance, the second check valve has failed, and fluid is vented from the back flow preventer.

Back flow preventer 10 is provided with a pair of check valves 20, 22 in the event second check valve 22 fails. If this occurs, first check valve 20 will still function to prevent back flow, and fluid urged against valve head 58 will not break the first check valve 20, but will instead be exited from housing 12 through vent 26. FIG. 3 shows the back flow preventer 10 of FIGS. 1 and 2 during a failed condition in which second check valve 22 has failed, and fluid is exiting housing 12 through vent 26. As can be seen in the failed condition, which is also true during the at rest position and other back flow conditions, resilient diaphragm 24 does not isolate passageway 14 from annular chamber 48. As such, passageway 14 is in fluid communication with annular chamber 48 and exhaust passageway 50 of vent 26. Fluid forced up into back flow preventer 10 will flow through second check valve 22 and will be allowed to exit passageway 14 through annular chamber 48 and exhaust passageway 50. During the failed condition, a user may notice fluid exiting housing 12, hence alerting the user that the second check valve 22 has failed.

In accordance with one exemplary embodiment of the present invention, inlet 16 may be adapted to be attachable directly to a pump 30 as shown in FIG. 3. Attachment to pump 30 may be made, for instance, by a threaded connection, clips, pins, bolts or a frictional engagement between these two components. By connecting inlet 16 directly to pump 30, fittings associated with a tube between pump 30 and inlet 16 are avoided. Outlet 18 may be adapted to be connected to a stainless steel tube 32 in a manner similar to the connection between pump 30 and inlet 16. Connection between these previously mentioned components may be made in any manner commonly known to one of ordinary skill in the art. Alternatively, back flow preventer 10 may be configured so that both inlet 16 and outlet 18 are attachable to piping in a water supply system.

First and second check valves 20, 22 may be manufactured assemblies or may be pre-made assemblies that are purchased and incorporated into back flow preventer 10. For instance, in accordance with one exemplary embodiment of the present invention first check valve 20 is a manufactured assembly while second check valve 22 is a pre-made, purchased component. Second check valve 22 may be a substantially plastic check valve having part number DW13KK manufactured by NEOPERL®, Inc. of 171 Mattatuck Heights, Waterbury, Conn. 06705. As can be imagined, various components of back flow preventer 10 can be selected or sized based on the operating parameters black flow preventer 10 is designed to experience. For instance, first and second check valves 20, 22 may be selected or sized based on the flow rate through back flow preventer 10, back flow pressure found in the system to which back flow preventer 10 is incorporated, or selected in response to other parameters.

It should be understood that the present invention includes various modifications that can be made to the back flow preventer 10 as described herein that come within the scope of the appended claims and their equivalents.

What is claimed is:

1. A back flow preventer, comprising:

a housing having a passageway configured for the transport of a fluid therethrough, the housing having an inlet made of a material that is copper based and an outlet defining at least a portion of the passageway, the inlet made of a different material than the outlet;

a first check valve disposed in the passageway, the first check valve configured for allowing fluid to flow through the passageway in the direction from the inlet to the outlet; and a second check valve disposed in the passageway, the second check valve configured for allowing fluid to flow through the passageway in the direction from the inlet to the outlet.

2. The back flow preventer as set forth in claim 1, further comprising a resilient diaphragm disposed in the passageway and engaging the first check valve; and wherein the housing defines a vent located between the first and second check valves, and wherein during a failed condition the passageway is in fluid communication with the vent and fluid located between the first and second check valves exits the housing through the vent.

3. The back flow preventer as set forth in claim 1, wherein the inlet is made of brass.

4. The back flow preventer as set forth in claim 1, wherein the outlet is made of stainless steel.

5. The back flow preventer as set forth in claim 1, wherein the surface of the housing forming the passageway from the inlet to a seat of the first check valve is made of a copper based material, and wherein the surface of the housing forming the passageway from the seat of the first check valve to the outlet is made of a non-copper based material.

6. The back flow preventer as set forth in claim 1, wherein the inlet is configured so as to be threaded directly onto a pump, and wherein the outlet is configured for attachment to a stainless steel tube.

7. The back flow preventer as set forth in claim 1, wherein the first and second check valves are poppet type valves, and wherein the second check valve is made at least partially of plastic.

8. The back flow preventer as set forth in claim 1, wherein the inlet is made of brass and the outlet is made of stainless steel.

9. The back flow preventer as set forth in claim 1, wherein the outlet is made of plastic.

10. A back flow preventer, comprising:

a housing having a body intermediate an inlet and an outlet, the inlet having an inlet surface that defines an inlet passageway, the inlet surface is made of a first material, the body having a body surface that defines a body passageway, the body surface is made of a second material, the outlet having an outlet surface that defines an outlet passageway, the outlet surface is made of a third material, the inlet passageway, body passageway, and outlet passageway are configured for allowing the transport of a fluid therethrough;

a first check valve having a first check valve seat, the first check valve seat is disposed between the inlet passageway and the body passageway, the first check valve is configured for allowing fluid to flow from the inlet passageway to the body passageway;

a second check valve disposed in the body passageway and configured for allowing fluid to flow from the body passageway to the outlet passageway; and wherein the first material is different than the second and third materials, and wherein the first material is copper based.

11. The back flow preventer as set forth in claim 10, wherein the second and third materials are the same material.

12. The back flow preventer as set forth in claim 11, wherein the first material is brass and the second and third materials are stainless Steel.

13. The back flow preventer as set forth in claim 10, further comprising a resilient diaphragm incorporated into the first check valve seat; and wherein the body defines an annular chamber located radially outward from the body passageway, wherein the inlet and the body define an exhaust passageway in communication with the annular chamber and the outside of the housing, the annular chamber and the exhaust passageway forming a vent; and wherein the resilient diaphragm selectively isolates the annular chamber from the body passageway such that in a failed condition the resilient diaphragm is open in order to place the body passageway into communication with the annular chamber and allow fluid in the body passageway to be transported into the annular chamber, into the exhaust passageway, and out of the housing.

14. The back flow preventer as set forth in claim 10, wherein the first material is brass.

15. The back flow preventer as set forth in claim 10, wherein the second and third materials are both stainless steel.

16. The back flow preventer as set forth in claim 10, wherein the first material is copper based, and wherein both the second and third materials are non-copper based.

17. The back flow preventer as set forth in claim 10, wherein the inlet is configured so as to be threaded directly onto a pump.

18. The back flow preventer as set forth in claim 10, wherein the first and second check valves are poppet type valves, and wherein the second check valve is made at least partially of plastic.

19. The back flow preventer as set forth in claim 10, wherein the second and third materials are both plastic.

20. A back flow preventer, comprising:

a housing having a body intermediate an inlet and an outlet, the inlet having an inlet surface that defines an inlet passageway, the inlet surface is made of brass, the body having a body surface that defines a body passageway, the body surface is made of stainless steel, the outlet having an outlet surface that defines an outlet passageway, the outlet surface is made of stainless steel, the inlet passageway, body passageway, and outlet passageway are configured for allowing the transport of a fluid therethrough;

a first check valve having a first check valve seat, the first check valve seat is disposed between the inlet passageway and the body passageway, the first check valve is configured for allowing fluid to flow from the inlet passageway to the body passageway;

a second check valve disposed in the body passageway and configured for allowing fluid to flow from the body passageway to the outlet passageway;

a resilient diaphragm incorporated into the first check valve seat; and wherein the housing defines a vent located between the first and second check valves, wherein the vent is selectively isolated from the body passageway by the resilient diaphragm, and wherein during a failed condition the resilient diaphragm is open such that the body passageway is in fluid communication with the vent and fluid located in the body passageway exits the housing through the vent.

* * * * *